United States Patent [19]

Hamaguchi et al.

[11] 4,230,283

[45] Oct. 28, 1980

[54] YARN-INTRODUCING AND TAKE-UP DEVICE APPLIED TO A WINDING MACHINE

[75] Inventors: Masayoshi Hamaguchi; Hiroshi Watanabe, both of Otsu; Itaru Hasegawa, Mishima, all of Japan

[73] Assignee: Toray Industries, Inc., Tokyo, Japan

[21] Appl. No.: 968,296

[22] Filed: Dec. 11, 1978

[30] Foreign Application Priority Data

Dec. 12, 1977 [JP] Japan ..... 52/148216

[51] Int. Cl.[3] ..... B65H 54/02; B65H 54/20

[52] U.S. Cl. ..... 242/18 PW; 242/35.5 R

[58] Field of Search ..... 242/18 PW X, 18 A, 18 DD, 242/18 R, 25 A, 35.5 R, 35.5 A

[56] References Cited

U.S. PATENT DOCUMENTS

| | | | |
|---|---|---|---|
| 3,782,648 | 1/1974 | Ito et al. | 242/35.5 R |
| 4,023,741 | 5/1977 | Schar | 242/18 PW X |
| 4,069,983 | 1/1978 | Muramatsu et al. | 242/18 PW |
| 4,081,149 | 3/1978 | Miller | 242/18 PW |
| 4,094,471 | 6/1978 | Tschentscher | 242/18 PW |
| 4,102,508 | 7/1978 | Stegelman | 242/18 PW |
| 4,136,834 | 1/1979 | Tschentscher | 242/18 PW |

FOREIGN PATENT DOCUMENTS

| | | | |
|---|---|---|---|
| 2378708 | 9/1978 | France | 242/18 PW |

*Primary Examiner*—Stanley N. Gilreath
*Attorney, Agent, or Firm*—Miller & Prestia

[57] ABSTRACT

In a winding machine provided with a common bobbin holder for mounting a plurality of bobbins thereon at respective winding positions, a traverse mechanism provided with a plurality of working units, a plurality of fulcrum yarn guides disposed at respective positions above the traverse mechanism, means for collecting a plurality of yarns fed via the respective fulcrum yarn guides, means for displacing the collecting means along the common bobbin holder from a stand-by position to the supporting side of the bobbin holder, a yarn introducing and take-up device is additionally mounted on the machine so as to separately introduce the yarns one by one to the corresponding working units of the traverse mechanism while displacing the collecting means after collecting the yarns fed via the respective fulcrum yarn guides, the introducing and take-up device is provided with a yarn introducing guide disposed at a position between the fulcrum yarn guides and the traverse mechanism in a parallel condition to the bobbin holder, this yarn introducing guide comprises plural guide units with an intervened space between two adjacent guide units by which the above-mentioned selective introducing of each single yarn to the corresponding working unit of the traverse guide can be attained.

7 Claims, 13 Drawing Figures

YARN-INTRODUCING AND TAKE-UP DEVICE APPLIED TO A WINDING MACHINE

BACKGROUND OF THE INVENTION

The present invention relates to an improvement in a multiple yarn winding apparatus for threading, taking up and winding a plural number of yarns independently on the respective bobbins mounted on a common bobbin holder.

According to a recent technique of winding synthetic yarns, a plural number of bobbins are mounted on a common bobbin holder and they are simultaneously driven by applying a surface drive system or a spindle drive system. A plural number of yarns are independently threaded in the corresponding thread guides and wound on the respective bobbins while the yarns are traversed by the respective traverse guides. The winding machines of this type are widely used in the art. The apparatus disclosed in the U.S. Pat. No. 3,782,648 applies a principle of threading and taking up similar to the above-mentioned threading and taking up principle which is hereinafter described in more detail.

According to the principle in the above mentioned patent, a plural number of fed yarns, for example, four fed yarns $y_1$, $y_2$, $y_3$ and $y_4$, are independently taken up onto corresponding fulcrum guides $g_1$, $g_2$, $g_3$ and $g_4$, and the yarns are bundled by means of one common bundling guide G. Then, the yarn bundle is hooked on a yarn pinching appendage 5 disposed in the end portion of a yarn winding bobbin 3 located at the outermost position and free end side of a common bobbin holder 36, and thus, the yarn is wound on this bobbin 3. When the yarn bundle on the bundling guide G is taken out from the bundling guide G, the bundle is moved toward the supporting side of the bobbin holder (hereinafter referred to as the inside of the bobbin holder) by the tension on the yarn bundle, and the respective yarns are automatically caught by corresponding traverse grooved drum 1 of a common traverse device. Thus, the yarns are wound while being traversed.

In the winding apparatus applying the above mentioned threading and taking up principle, the yarns $y_1$, $y_2$, $y_3$ and $y_4$ to be wound on bobbins located apart from the bundling guide G, are taken out from the bundling guide G and shifted to the traverse position by the tension of the yarns. However, in such operation the yarns $y_2$, $y_3$ and $y_4$ are firstly engaged with the first traverse grooves 10, 11 of the traverse device 3, which is the closest to the bundling guide G, and then, they are wound in the state where they are not engaged with the second traverse grooves 12, 13, the third traverse grooves 14, 15 and the fourth traverse grooves 16, 17 located at predetermined winding positions. Accordingly, an operator has to separate these yarns from the first traverse grooves 10, 11 and move them to the corresponding traverse grooves located at the predetermined winding positions. Therefore, it is impossible to wind a plural number of yarns simultaneously on the corresponding bobbin at a high speed, and consequently, operating efficiency is inevitably lowered. Moreover, according to the above mentioned threading and take-up method, since the yarns from the bundling guide G are directly caught by the first traverse grooves 10, 11 the second traverse grooves 12, 13, the third traverse grooves 14, 15 and fourth traverse grooves 16, 17, respectively, and wound on the corresponding bobbins, there is a drawback in that it is impossible to form a tail winding on the end portion of the respective bobbins. Therefore, in the conventional winding apparatus applying the above mentioned principle, there is a problem involved in the threading of yarns to the respective traverse guide at the start of the take-up and winding operation.

SUMMARY OF THE INVENTION

It is a primary object of the present invention to provide a winding apparatus in which the above-mentioned drawbacks of the conventional apparatus are eliminated. In accordance with the present invention, this object can be attained by the following apparatus, provided with a particular auxiliary device for threading and taking up yarns. That is, in a winding machine of the so-called surface drawing system comprising a common bobbin holder for mounting a plural number of bobbins and a traverse mechanism comprising a plural number of working units, each having a traverse guide arranged at the respective positions corresponding to the mounting positions of the bobbins, a plural number of fulcrum yarn guides disposed at the respective positions above the corresponding traverse guides and a friction roller for driving the bobbins or yarn packages forming on the above-mentioned bobbins by the friction contact, the threading and take-up device according to the present invention comprises means for bundling the yarns from the fulcrum guides, which is capable of displacing from an outside of the free end of the common bobbin holder to the supporting side thereof in parallel with the long axis of the common bobbin holder, means for moving the bundling means in parallel with the long axis of the common bobbin holder, guide means for separately introducing plural yarns to the corresponding working units one by one in such a condition that they do not engage the respective traverse guides of the working units while displacing the above-mentioned bundling means and means for catching the yarns on the respective bobbins after introducing those yarns to the corresponding working units of the traverse mechanism. Furthermore, if it is required to produce yarn packages having a bunch wind or a tail wind, it is preferable to modify the above-mentioned guide means in such a way that, when the respective yarns are introduced into the corresponding working units of the traverse mechanism, each yarn is guided to the end portion of the corresponding bobbin.

In the case where the so-called spindle drive system is applied to rotate the bobbins, the above-mentioned auxiliary device can be utilized with the same functional effect as mentioned above.

When it is required to thread the yarns into the respective traverse guides and take them up by the respective bobbins mounted on a common bobbin holder at the time of starting the winding operation, those yarns fed from the corresponding fulcrum yarn guides are firstly collected and bundled by a common bundling guide positioned outside the common bobbin holder. Thereafter, the yarns are automatically introduced one by one into the corresponding working units of the traverse device by displacing the bundle portion of the above-mentioned bundled yarns from the outside position of the common bobbin holder toward the supporting side of the common bobbin holder. This is done in sequential order from the yarn fed via a first fulcrum yarn guide, corresponding to a first bobbin mounted on the common bobbin holder at the most free-end side position thereof, to the yarn fed via a last fulcrum thread guide, corresponding to a last bobbin mounted on the common bobbin holder at the most inside position thereof. Thereafter the above-mentioned introduced yarns are simultaneously wound on the respective bobbins by contacting those yarns with the corresponding bobbins.

In this condition, since each of the yarns from the respective fulcrum yarn guide crosses a running passage of the corresponding traverse guide, each thread can be caught by the corresponding traverse guide so that the normal winding operation can be commenced. Accordingly, it is possible to automatically and assuredly take up a plural number of yarns onto a high speed winding machine at the time of commencing the winding operation in any condition of forming such yarn packages, with or without bunch or tail windings on the respective winding bobbins.

DETAILED EXPLANATION OF THE INVENTION

Figure 1:
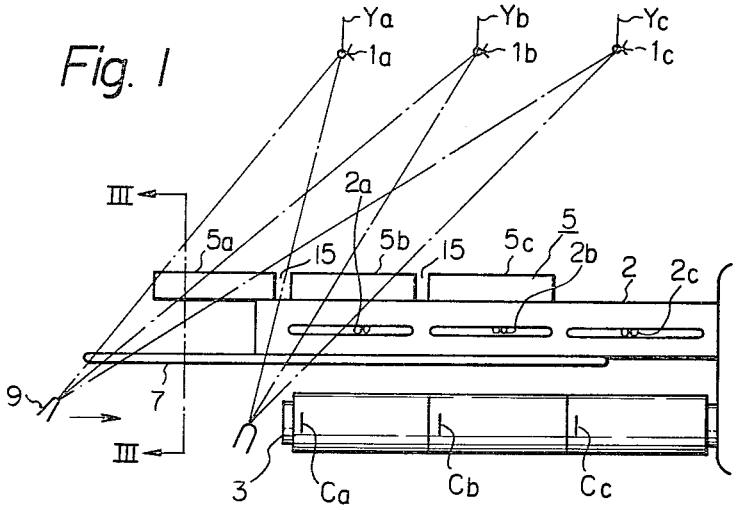
FIG. 1 is a front view illustrating diagrammatically the positional relationship among yarn guide units of the auxiliary device for introducing and taking up a plurality of yarns in the most simple embodiment of the apparatus of the present invention.
Figure 2A:
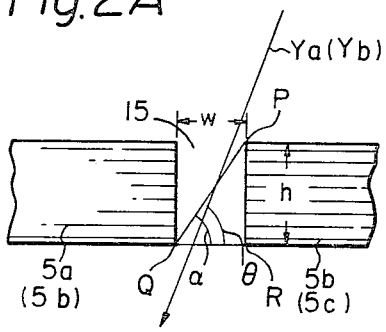
FIGS. 2A and 2B are enlarged front views of two adjacent yarn guide units of the auxiliary device shown in FIG. 1.
Figure 2B:
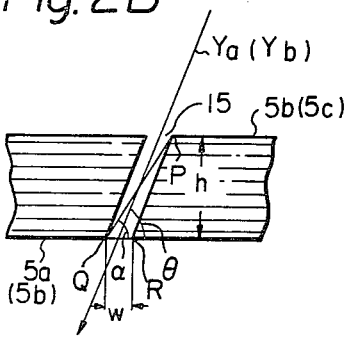
Figure 3:
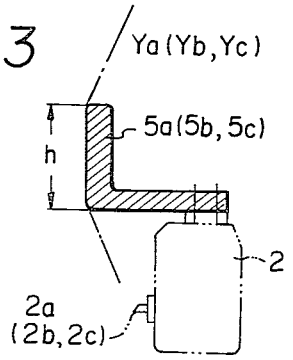
FIG. 3 is a sectional view of the yarn guide unit of the auxiliary device taken along the line III—III in FIG. 1.
Figure 4:
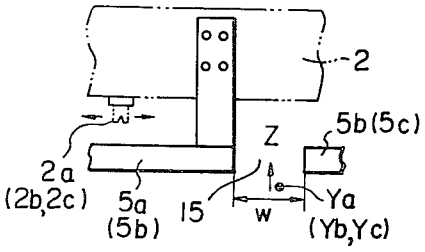
FIG. 4 is a schematic elevational view of the yarn guide units of the auxiliary device shown in FIG. 3.

For the sake of a better understanding of the present invention, a simple embodiment of the auxiliary device according to the present invention will first be explained in detail with reference to FIGS. 1, 2A, 2B, 3 and 4. In this embodiment the auxiliary device is attached to a winding apparatus comprising: a common bobbin holder 3 rotatably and horizontally supported by a gear box, a traverse mechanism 2 provided with a plurality of working units for guiding yarns to plural bobbins mounted on a common bobbin holder by means of respective traverse guides 2*a*, 2*b*, 2*c* thereof; plural fulcrum yarn guides 1*a*, 1*b*, 1*c* disposed above the traverse mechanism 2 at the respective positions corresponding to the working units of the traverse mechanism 2. In this embodiment, the auxiliary device according to the present invention comprises: a yarn-introducing guide 5 provided with three guide units 5*a*, 5*b*, 5*c*, arranged in alignment with respective slits 15, having an identical space between two adjacent units at the respective positions, which is hereinafter explained in detail; an auxiliary yarn guide 7 disposed at a position between the above-mentioned yarn-introducing guide 5 and in parallel to the longitudinal axis of the common bobbin holder 3; a yarn bundling guide 9 disposed at a position below the auxiliary yarn guide 7, in such condition that the yarn bundling guide 9 is capable of being displaced along the longitudinal axis of the common bobbin holder 3 from a position outside a free end of the common bobbin holder 3 to a position adjacent to the supporting side of the common bobbin holder 3, and; means for displacing the bundling guide 9 as mentioned above. The yarn-introducing guide 5 is disposed at a position above the common bobbin holder and in parallel thereto. The yarn-contacting surface of each guide units 5*a*, 5*b* and 5*c* of the yarn-introducing guide 5 is located at a projected position from the passage of the traverse guides 2*a*, 2*b* and 2*c*, respectively, as illustrated in FIGS. 3 and 4. As illustrated in FIG. 3, when yarns Ya, Yb and Yc are displaced toward the supporting side of the common bobbin holder 3, while sliding on the contacting surface of the respective guide units 5*a*, 5*b*, 5*c* of the yarn-introducing guide 5 by displacing the yarn bundling guide 9, each yarn Ya, Yb, Yc passes along the respective passages represented by the one dash line in FIG. 3. Therefore, these yarns Ya, Yb, Yc can be introduced into a space Z formed between the traverse mechanism 2 and the introducing guide 5, in such a condition that each one of these yarns is capable of passing through the respective slits 15, as shown in FIG. 4.

The arrangement and relationship between two adjacent guide units (5*a*, 5*b*) (5*b*, 5*c*) in the connection with the respective slits 15 will now be explained in detail. In FIG. 2A, which is a partial enlargement of the yarn-introducing guide 5, the width and the thickness of the slits 15 formed between two adjacent guide units 5*a* and 5*b* (5*b* and 5*c*) are represented by w and h, respectively; an angle between a line passing through an upper corner point P of the guide unit 5*b* and a lower corner point Q of the guide unit 5*a*, and a line passing through the lower point Q of the guide unit 5*a* and a lower corner point R of the guide unit 5*b* is represented by $\alpha$, and; an angle between a yarn Ya, which passes from the fulcrum yarn guide la and the yarn bundling guide 9, and a line between the lower corner point Q of the guide unit 5*a* and the lower corner point R of the guide unit 5*b* is represented by $\theta$. When the yarn bundling guide 9 is displaced toward the supporting side of the common bobbin holder, if the above-mentioned angle $\alpha$ is set so that $\theta \geqq \alpha$, the yarn Ya can be freely introduced into the slit 15 formed between the guide units 5*a* and 5*b*. To prevent the possibility of freely introducing the yarns Yb and Yc into the above-mentioned slit 15, it is essential to form an angle $\theta$b between the yarn Yb and the line $\overline{QR}$ and an angle $\theta$c between the yarn Yc and the line $\overline{QR}$ in such a condition that $\theta$b, $\theta$c are smaller than the above-mentioned angle $\theta$. The above-mentioned condition regarding the angle between the line $\overline{PQ}$ and the line $\overline{QR}$, in connection with the angle regarding the yarns Ya, Yb and Yc is the essential condition to introducing only the yarn Ya into the slit 15 between the guide units 5*a* and 5*b* while displacing the yarn bundling guide 9 toward the supporting side of common bobbin holder. The condition of the slit 15 between the guide units 5*b* and 5*c* is chosen for the yarns Yb and Yc in a similar way to the above-mentioned condition. Therefore, generally speaking, if the relative condition between the disposition of the guide units of the introducing guide 5, the thickness of the guide units, the disposition of the fulcrum yarn guides 1*a*, 1*b*, 1*c* . . . , the passing trace of the yarn bundling guide 9 is chosen so as to satisfy the above-mentioned conditions, only one yarn can be introduced into a corresponding slit 15 during the above-mentioned displacement of the yarn bundling guide 9. With respect to the last yarn which is supplied to the bobbin mounted on the common bobbin holder at the most inside thereof, so as to introduce this yarn to the working unit of the corresponding traverse mechanism 2, it is sufficient to use such a guide unit which is terminated at a position corresponding the range of the traverse motion of the traverse guide of the working unit of the traverse mechanism. This is because there is not any requirement to prevent the possibility of introducing another yarn into the above-mentioned working unit of the traverse mechanism.

In the above-mentioned embodiment, the slit 15 formed between the two adjacent guide units 5*a* and 5*b* (5*b* and 5*c*) is explained. However, even in such a case where a slit 15 having the shape of parallelogram in the front view thereof is utilized, as shown in FIG. 2B, the same condition regarding the angle between the line $\overline{PQ}$ and the line $\overline{QR}$, in connection with the angle between the yarns Ya, Yb, Yc and the line $\overline{QR}$, as explained in the embodiment shown in FIG. 2A is applied.

Figure 5:
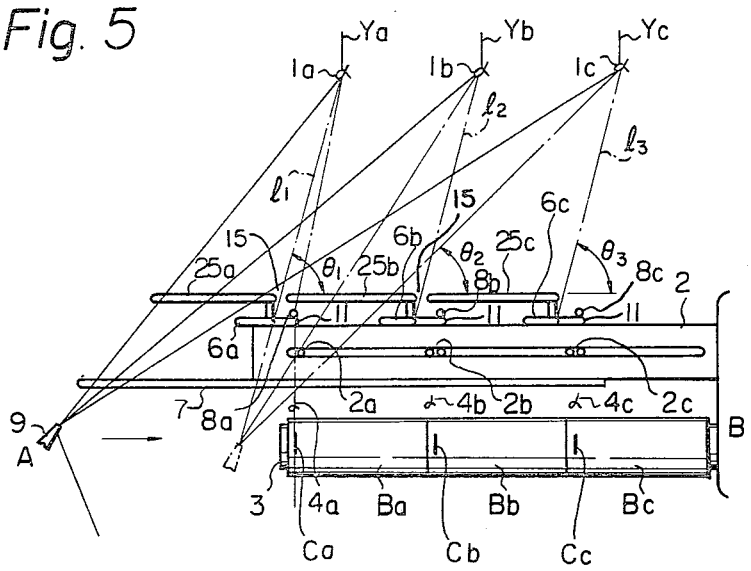
FIG. 5 is a front view of a modified embodiment of the apparatus of the present invention.
Figure 6:
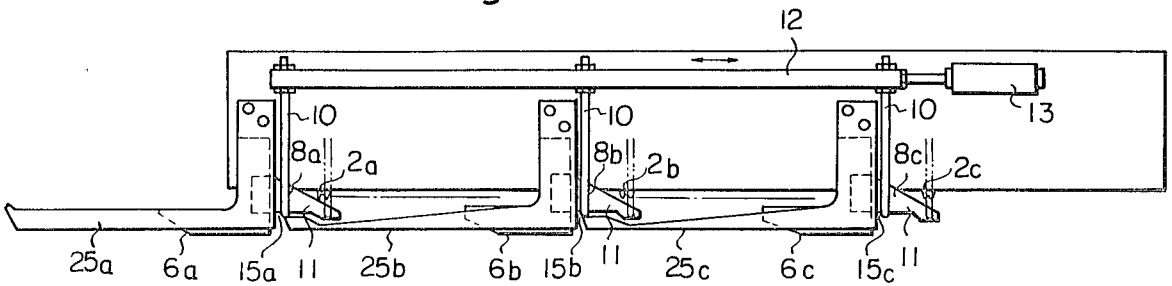
FIG. 6 is an enlarged plan view illustrating the yarn guide units of the apparatus illustrated in FIG. 5.
Figure 7B:
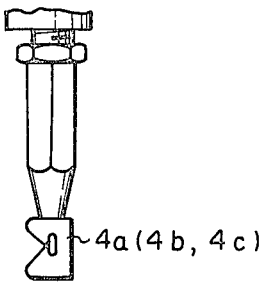
FIGS. 7A and 7B are side and front views of the take-up guide of the apparatus illustrated in FIG. 5.
Figure 7A:
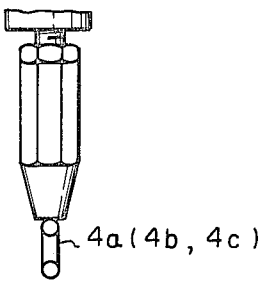
Figure 8:
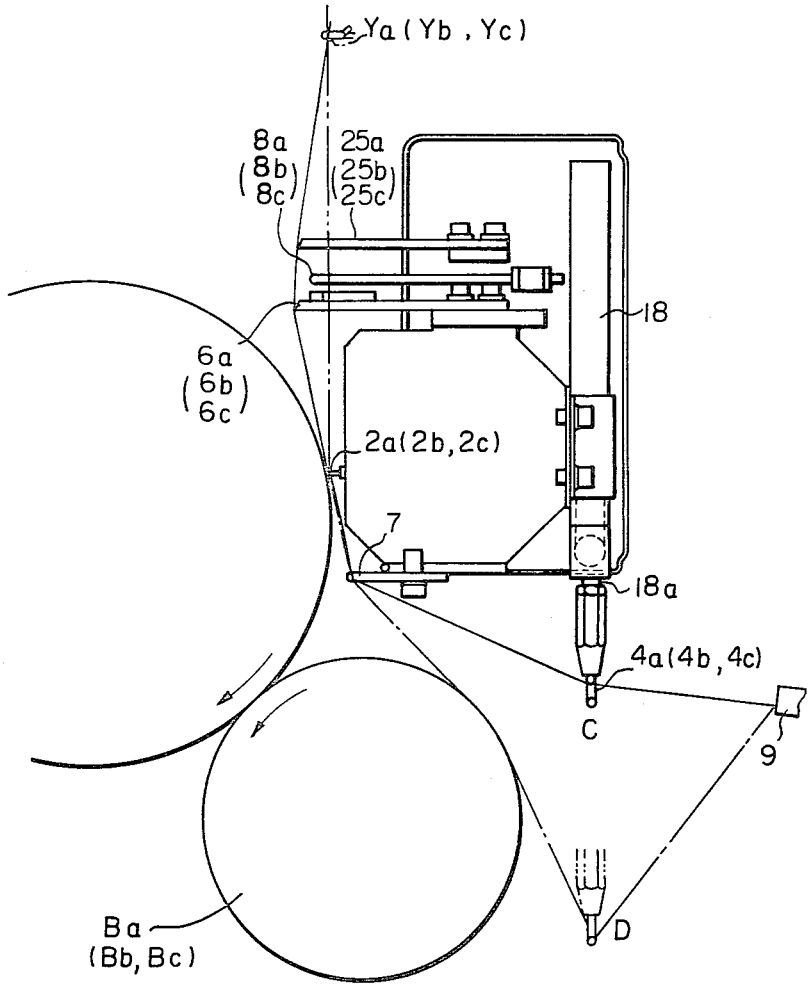
FIG. 8 is a side view illustrating diagrammatically one unit of the apparatus shown in FIG. 5.

Next, the structure and function of the most practical embodiment of the device according to the present invention is will be explained in detail with reference to FIGS. 5, 6, 7A, 7B and 8. In this embodiment, the elements corresponding to the elements of the above-mentioned first element according to the present invention are represented by the identical reference numerals and the explanation of these element is omitted as much as possible. In this embodiment, winding bobbins Ba, Bb and Bc are attached to the common bobbin holder 3, and guides 4*a*, 4*b* and 4*c* are mounted to take up yarns Ya, Yb and Yc and wind them onto the bobbins Ba, Bb and Bc. Each of the bobbins Ba, Bb and Bc is provided with yarn catching slits Ca, Cb, Cc, respectively. The yarn take-up guides 4*a*, 4*b* and 4*c* are held on a plunger 18*a* of a hydraulic cylinder 18 so that they are shifted from the stand-by position C (see FIG. 8) to the yarn take-up position D (see FIG. 8) by the operation of the hydraulic cylinder 18. Upper guides 25*a*, 25*b* and 25*c*, having a similar function to the upper edge of the guide units 5*a*, 5*b* and 5*c* of the above-mentioned first embodiment, are disposed in the upper portion of the traverse mechanism 2 for introducing the yarns into the space before the respective working units of the traverse mechanism 2. Corresponding lower guide units 6*a*, 6*b* and 6*c*, having a similar function to the lower edge of the guide units 5*a*, 5*b* and 5*c* of the above-mentioned first embodiment, are disposed at the respective positions between the upper guide units 25*a*, 25*b* and 25*c*, and the working units of the traverse mechanism 2. An auxiliary guide 7 is mounted at a position between the traverse mechanism 2 and the common bobbin holder 3 and is parallel to the bobbin holder 3. This auxiliary guide 7 works to prevent the possible engagement of the yarns Ya, Yb and Yc with the corresponding traverse guides 2*a*, 2*b* and 2*c* during the operation of threading those yarns into the corresponding slits formed between the adjacent two upper guide units 25*a* and 25*b*, 25*b* and 25*c*, and a space immediately outside the upper guide unit 25*c*. Bunch and tail winding forming elements 8*a*, 8*b* and 8*c* are disposed at respective positions between the corresponding pairs of the upper guide unit and the lower guide unit 25*a* and 6*a*, 25*b* and 6*b*, 25*c* and 6*c*. These elements 8*a*, 8*b* and 8*c* comprise a yarn engaging guide 10 for forming a bunch and a guide 11 for forming tail windings respectively. These bunch and tail forming elements 8*a*, 8*b* and 8*c* are simultaneously driven by an actuation cylinder 13 or the like. More specifically, as shown in FIG. 6, the yarn engaging guides 10 of the bunch and tail forming elements 8*a*, 8*b* and 8*c* are fixed to a connecting rod 12 capable of reciprocative movement with a predetermined stroke by the action of a cylinder 13, and therefore, these yarn engaging guides 10 are simultaneously moved by the operation of the cylinder 13. In this embodiment, a suction nozzle is used as the yarn bundling guide 9.

It is indispensable that the upper guide units 25*a*, 25*b* and 25*c* should be arranged so that the slits 15 formed between two adjacent upper guide units are located above corresponding bunch and tail forming elements 8*a*, 8*b* and 8*c* respectively. In this embodiment, the upper guide units 25*a*, 25*b* and 25*c*, and the lower guide units 6*a*, 6*b* and 6*c* have similar functions to the functions of the upper edge and lower edge of the guide units 5*a*, 5*b* and 5*c* respectively. In other words, in this embodiment, the relation between an angle of a line passing an end point of the upper guide unit 25*b* at the side of the upper guide member 25*a* and a terminal point of the lower guide member 6*a* to the direction along the longitudinal axis of the common bobbin holder 3, and the angles of the yarns Ya, Yb, Yc between the corresponding fulcrum yarn guides 1*a*, 1*b*, 1*c* and the suction nozzle 9 to the direction along the longitudinal axis of the common bobbin holder 3 satisfies the general conditions applied for the first embodiment. Such condition is also satisfied in connection with the slit 15 formed between the upper guide units 25*b* and 25*c*. With respect to the upper guide unit 25*c* and the lower guide unit 6*c*, in connection with the bobbin Bc, a condition similar to the guide unit 5*c* of the first embodiment is set.

Next, the thread introducing and taking up operation utilizing the above-mentioned second embodiment will be explained in detail. When the fresh bobbins Ba, Bb and Bc are mounted on the common bobbin holder 3, as shown in FIG. 5, and the winding operation is about to start, the fed yarns Ya, Yb and Yc are independently passed through the fulcrum yarn guides 1*a*, 1*b* and 1*c*, respectively, and then, they are bundled by the suction nozzle 9. The suction nozzle 9 is brought into a stand-by position A on the open side of the bobbin holder 3 and then the suction nozzle 9 is displaced in the direction B to the supporting side of the common bobbin holder 3 in the state where the yarns Ya, Yb and Yc are kept in contact with the upper guide unit 25*a* and the auxiliary guide 7. By this movement of the suction nozzle 9, the yarn Yc is allowed to pass over the slit 15 between the upper guide units 5a and 5b, without falling into said slit 15, while being in contact with the lower guide unit 6*a* between the upper guide unit 25*a* and the auxiliary guide 7. Accordingly, the yarn Yc is moved from the upper guide unit 25*a* onto the upper guide unit 25*b*. Also the yarn Yb slides on the contacting surface of the upper guide units 25*a* and 25*b*, the auxiliary guide 7 and the lower guide unit 6a between the upper guide unit 25*a* and the auxiliary guide 7, and passes over the slit 15 between the guide units 25*a* and 25*b* without falling into this slit 15. The yarn Ya is moved while in contact with the upper guide unit 25*a*, auxiliary guide 7 and lower guide unit 6*a*. When the yarn Ya comes to the terminal end of the lower guide unit 6*a*, the yarn Ya is positioned in the slit 15. Since the yarns Ya, Yb, Yc are always forced to the contacting surface of the upper guide units 25*a*, 25*b*, 25*c* and the lower guide units 6*a*, 6*b*, 6*c* while being displaced by the movement of the suction nozzle 9, because these guide units are projected forward from the traverse mechanism in a similar condition to the first embodiment shown in FIG. 3, the yarn Ya is freely introduced into the slit 15 formed at a position between the upper guide units 25*a* and 25*b*, and passes through this slit 15. As a result, the yarn Ya is allowed to fall down into a predetermined yarn engaging portion 15*a* formed in a space defined by the lower guide unit 6*a* and the upper guide unit 25*b*, and it is divided from the other yarns Yb and Yc and held at the position of this yarn engaging portion 15*a*. Then, the yarn Ya is taken up onto a take-up guide 4*a*, according to the manual displacement of the suction nozzle 9 in the direction B. Take-up by the guides 4*b*, 4*c*, is carried out in a manner similar to that of guide 4*a*.

When the suction nozzle 9 is further moved in the direction B, the yarn Yc falls into contact with the upper guide units 25*b* and 25*c*, the auxiliary guide 7 and the lower guide unit 6*b*, between the upper guide unit 25*b* and auxiliary guide 7, and passes over a guiding slit adjacent to the yarn engaging portion 15*b* formed in a space defined by the lower guide unit 6b and the upper guide unit 25*c* of the bunch and tail forming element 8*b*. The yarn Yb is similarly moved while in contact with the upper guide unit 25*b*, auxiliary guide 7 and the lower guide unit 6*b*. When the yarn Yb comes to the terminal of the lower guide unit 6*b*, the yarn Yb is positioned in the slit 15 formed between the upper guide units 25*b* and 25*c*. Therefore, the yarn Yb is freely introduced into the slit 15 and passes through this slit 15 in a similar manner to the above-mentioned motion of the yarn Ya, while the yarn Yc passes over this slit 15 in a similar manner as that in which the yarns Yb, Yc pass over the slit 15 formed between the upper yarn guide units 25*a* and 25*b*. As a result of the above-mentioned movement of the yarns Yb, Yc, the yarn Yb is allowed to fall into the predetermined yarn engaging portion 15*b*, whereby the yarn Yb is divided from the yarn Yc. The yarn Yb is held at this position and taken up onto the take-up guide 4*b*.

When the suction nozzle 9 is further displaced in the direction B and the yarn Yc comes to the terminal of the lower guide unit 6*c*, the yarn can be freely introduced to a yarn-engaging portion 15*c*, formed in a space immediately outside the lower guide unit 6*c*, and then, the yarn Yc is held at this position and taken-up onto the take-up guide 4*c*.

When distribution of the above-mentioned introduction and take-up of the yarns Ya, Yb and Yc onto the corresponding take-up guides 4*a*, 4*b* and 4*c* is thus completed, the yarn take-up guides 4*a*, 4*b* and 4*c* are simultaneously operated to catch the respective yarns Ya, Yb, Yc, by the respective catching slits Ca, Cb, Cc formed on each bobbin so as to wind the yarns on the bobbins Ba, Bb and Bc. At the same time, the yarns sucked to the suction gun 9 are cut to form bunches on the ends of the respective bobbins. Then, the bunch and tail forming devices 8*a*, 8*b* and 8*c* are operated to form predetermined tails. More specifically, as shown in FIG. 6, when the yarn engaging guides 10 of the bunch and tail forming devices 8*a*, 8*b* and 8*c* are moved toward the supporting side of the bobbin holder 3 by the operation of the cylinder 13, the yarns Ya, Yb and Yc are moved toward the direction of the supporting side of the bobbin holder 3 along the tail forming guides 11 to form tails. When the yarns separate from the free ends of the guides 11, they are caught by the corresponding traverse guides 2*a*, 2*b* and 2*c*, respectively, and the ordinary winding operation is started. Namely, after formation of tails, the yarns Ya, Yb and Yc separate from the bunch and tail forming devices 8*a*, 8*b* and 8*c* and they are moved along imaginary vertical lines from the respective fulcrum guides to the corresponding upper guide units 25*a*, 25*b* and 25*c* by the tensions on the respective yarns Ya, Yb and Yc. Then, these yarns are engaged with the traverse guides 2*a*, 2*b* and 2*c*, respectively, and are wound while being traversed.

Figure 9:
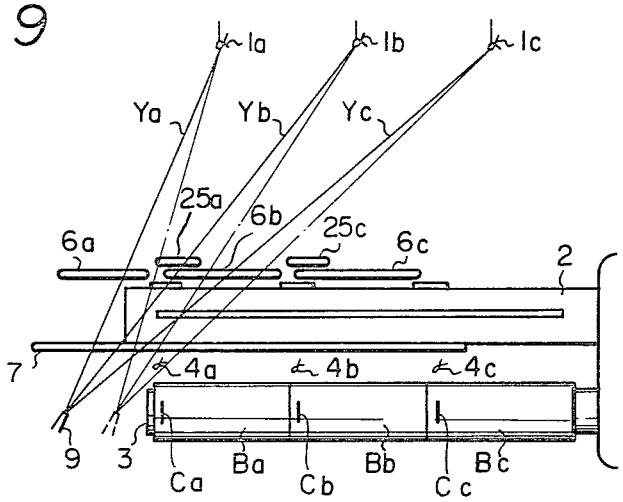
FIG. 9 is a front view illustrating diagrammatically the positional relationship among yarn guides in another modification where the upper and lower guide units of the apparatus illustrated in FIG. 5 are reversed.

The present invention is not limited to the above-mentioned embodiment, but various modifications and changes can be made thereto. For example, the upper and lower guides of the above-mentioned embodiment can be reversed. This modification is illustrated in FIG. 9. Since there is no substantial difference of the function between this modification and the above-mentioned second embodiment, a description of this modification is omitted.

Further, the objects of the present invention can be obtained by the following modifications.

(A) The number of yarns to be taken up and wound on the respective bobbins mounted on the common bobbin holder is not particularly critical, and the present invention can be applied to introduce, take-up and wind at least two yarns.

(B) Each unit of the traverse mechanism may be one comprising a rotary cam and a traverse guide and a split drum may be used as the traverse mechanism.

(C) The bobbon holder may be driven by drive means directly connected to the bobbon holder, or it may be frictionally driven by a driving roller rotated while having frictional contact with the respective bobbin holders.

(D) The operation of taking up yarns on corresponding bobbins by means of the take-up guides may be performed by one cylinder which is capable of operating one bracket on which the respective take-up guides are mounted, or this operation may be manually carried out by an operator.

(E) The operation of collecting and bundling yarns from the fulcrum guides and introducing them to corresponding take-up guides may be accomplished by moving the suction nozzle by an operator, as in the above-mentioned embodiment, or there may be adopted a structure in which the respective take-up guides are moved to predetermined positions by a fluid cylinder or thread engagement mechanism.

EXAMPLE

Figure 10:
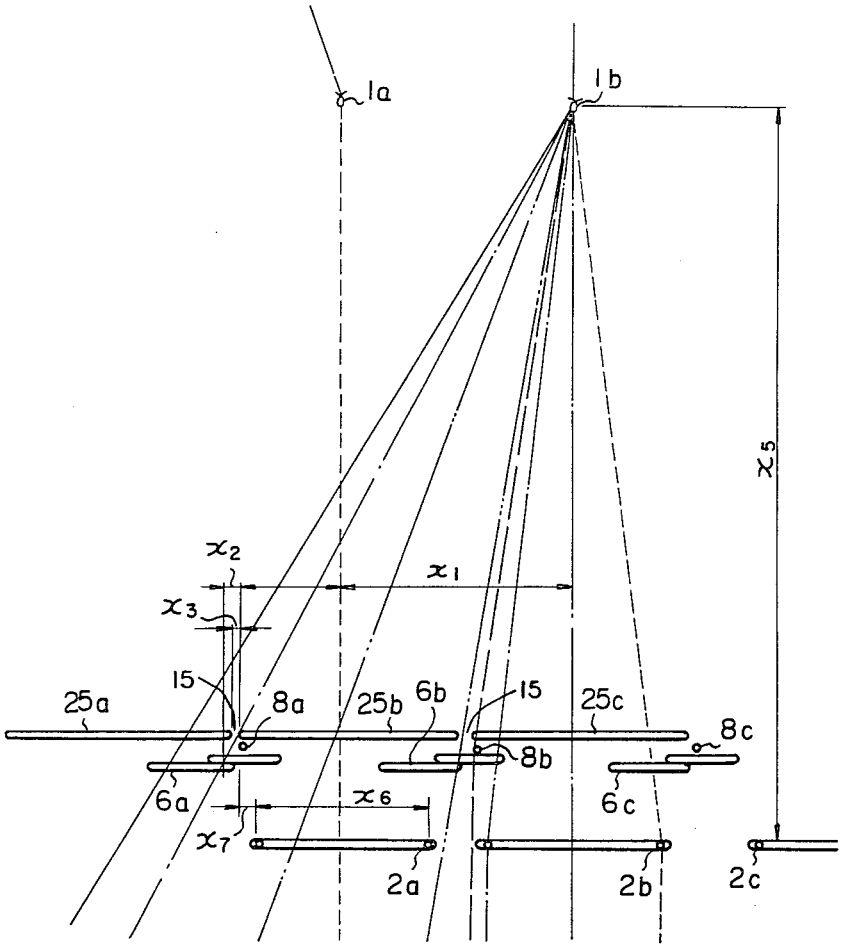
FIGS. 10 and 11 are front and side views illustrating the positional relationship among yarn guide units in a practical embodiment of the apparatus illustrated in FIGS. 5 through 8.
Figure 11:
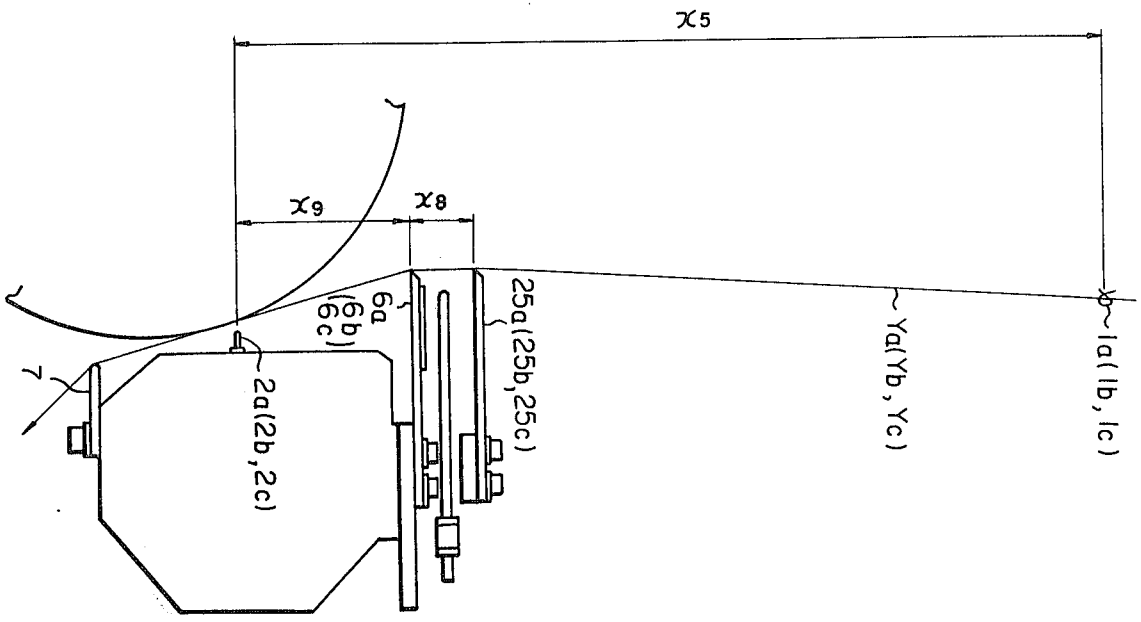

One specific example of the positional relationship among the upper and lower guide units in the embodiment shown in FIGS. 5 to 8 is set forth below (see FIGS. 10 and 11).

Distance $x_1$ between centers of two adjacent upper guide units: 150 mm

Slit $x_2$ between two adjacent upper guide units: 2 mm

Lateral deviation $x_3$ between the inner free end of the lower guide unit and the outer free end of the upper guide unit at the adjacent winding position: 5 mm Length $x_4$ of each upper guide unit: 146 mm Vertical distance $x_5$ between the fulcrum guide and auxiliary guide: 500 mm Traverse length $x_6$: 110 mm Tail length $x_7$: 18 mm Vertical distance $x_8$ between the upper and lower guide units: 19.5 mm Vertical distance $x_9$ between the lower guide unit and traverse guide: 50 mm

What we claim is:

1. A yarn-introducing and taking-up device attached to a winding machine provided with a common bobbin holder for mounting a plurality of bobbins thereon at respective winding positions, a traverse mechanism provided with a plurality of working units arranged at respective positions corresponding to said winding positions respectively, each of said working units provided with a traverse guide, a plurality of fulcrum yarn guides disposed at respective positions above said traverse mechanism, said traverse mechanism located at a position between said common bobbin holder and said fulcrum yarn guides, means for driving said bobbins mounted on said common bobbin holder, means for collecting a plurality of yarns fed via the respective fulcrum yarn guides, said collecting means being capable of being displaced along a longitudinal axis of said common bobbin holder from an outside position of a free end of said common bobbin holder toward a supporting side of said common bobbin holder, yarn catching slits for holding yarns fed from the respective fulcrum yarn guides on the respective bobbins mounted on said common bobbin holder, said device comprising a yarn-introducing guide disposed at a position between said group of fulcrum yarn guides and said traverse mechanism, said yarn-introducing guide comprising a plurality of guide units aligned in a row parallel to the axis of said common bobbin holder, with a slit between two adjacent guide units, each of said guide units provided with a sliding surface adapted to permit yarn to slide thereover while projecting the path of said yarn forward from an imaginary plane passing guide points of said fulcrum yarn guides and said traverse guides, said guide units arranged at respective positions satisfying the condition that, when said collecting means collects yarns fed via said fulcrum yarn guides and is displaced from said outside position toward said supporting side of said common bobbin holder, said yarns are capable of passing through the respective slits one by one so that each yarn is introduced into the corresponding working unit of said traverse mechanism in such a condition that only one yarn is capable of passing through the corresponding slit while the free passage of the other yarn or yarns through said corresponding slit is prevented by contact with a portion of said yarn-introducing guide, said displacement of said collecting means being continued until the last one of said yarn is introduced into the corresponding working unit of said traverse mechanism.

2. A yarn-introducing and take-up device according to claim 1, wherein said guide unit of said yarn-introducing guide located in closest proximity to said supporting side of said bobbin holder is terminated at a position corresponding to the range of the traverse motion of said traverse guide of the corresponding working unit of said traverse mechanism.

3. A yarn-introducing and take-up device according to claim 1, wherein each of said guide units of said yarn-introducing guide is a plate guide.

4. A yarn-introducing and take-up device according to claim 1, wherein each of said guide units comprises an upper guide element and a lower guide element separated in parallel condition.

5. A yarn-introducing and take-up device according to claim 1, further comprising means for temporarily reserving a yarn passed through said yarn-introducing guide toward the corresponding working unit of said traverse mechanism and means for displacing said reserve means toward said traverse guide of the corresponding working unit of said traverse mechanism.

6. A yarn-introducing and take-up device according to claim 5, wherein said temporarily reserving means is provided with a guide for forming a tail winding on the corresponding bobbin mounted on said common bobbin holder.

7. A yarn-introducing and take-up device according to claim 1, further comprising an auxiliary yarn guide disposed at a position between said traverse mechanism and said common bobbin holder in a parallel condition to the longitudinal axis of said common bobbin holder.

* * * * *

UNITED STATES PATENT AND TRADEMARK OFFICE

CERTIFICATE OF CORRECTION

PATENT NO. : 4,230,283

DATED : October 28, 1980

INVENTOR(S) : Masayoshi Hamaguchi et al.

It is certified that error appears in the above—identified patent and that said Letters Patent is hereby corrected as shown below:

On The Title Page, Assignee should read -- Toray Industries, Inc. and Toray Engineering Co., Ltd. --.

Signed and Sealed this

*Twelfth* Day of *May 1981*

[SEAL]

*Attest:*

RENE D. TEGTMEYER

*Attesting Officer*

*Acting Commissioner of Patents and Trademarks*